United States Patent [19]

Sentoku et al.

[11] Patent Number: 4,558,712

[45] Date of Patent: Dec. 17, 1985

[54] AUTOMATIC COIN DEPOSITING AND PAYING MACHINE

[75] Inventors: Hideshi Sentoku, Tokyo; Yoshiaki Uematsu, Hiratsuka, both of Japan

[73] Assignee: Laurel Bank Machine Co., Ltd., Tokyo, Japan

[21] Appl. No.: 510,588

[22] Filed: Jul. 5, 1983

[30] Foreign Application Priority Data

Jul. 8, 1982 [JP] Japan ..... 57-118990

[51] Int. Cl.[4] ..... G07D 1/02; G07D 3/14

[52] U.S. Cl. ..... 133/3 R; 133/5 R; 194/1 D; 194/99

[58] Field of Search ..... 133/3 R, 3 H, 4 R, 4 A, 133/5 R; 194/1 D, 1 K, 99, 100 A, 102, DIG. 28, DIG. 29

[56] References Cited

U.S. PATENT DOCUMENTS

| | | | |
|---|---|---|---|
| 1,553,979 | 9/1925 | Bryk | 133/3 F |
| 3,009,555 | 11/1961 | Seckula, Sr. | 133/3 R X |
| 4,286,703 | 9/1981 | Schuller et al. | 194/1 KR |
| 4,365,700 | 12/1982 | Arimoto et al. | 133/3 R X |

FOREIGN PATENT DOCUMENTS

| | | | |
|---|---|---|---|
| 52-73800 | 6/1977 | Japan | 194/1 D |
| 774178 | 5/1957 | United Kingdom | 133/3 R |
| 2034093 | 5/1980 | United Kingdom | 194/1 K |

*Primary Examiner*—F. J. Bartuska

*Attorney, Agent, or Firm*—Fleit, Jacobson, Cohn & Price

[57] ABSTRACT

An automatic coin depositing and paying machine having the function of receiving coins for deposit and paying out deposited coins. The coins are received in the machine through an inlet opening and are discriminated by a discriminator into acceptable coins and unacceptable coins. The acceptable coins are respectively stored in coin storing tubes in accordance with the denomination of coins discriminated by another discriminator. The coins stored in the coin storing tubes are used as pay-out coins. The paid out coins are conveyed by a lift belt to an exit which is located adjacent to the inlet opening. The unacceptable coins are also conveyed to the exit by the lift belt.

6 Claims, 2 Drawing Figures

AUTOMATIC COIN DEPOSITING AND PAYING MACHINE

BACKGROUND OF THE INVENTION

1. Field of the Invention

The present invention relates to an automatic coin depositing and paying machine which is made operative to select and temporarily store coins received and to reuse the selected and stored coins as payable ones.

2. Description of the Prior Art

In the prior art, there have been used a number of coin counting machines which have a function to automatically discriminate the kinds of coins received thereby to receive and count genuine ones. There have also been used a number of coin paying machines which have a function to store genuine coins in coin storing tubes thereby to pay off them one by one from the lower portions of those coin storing tubes.

However, the machines of those two kinds are not considered in respect of enhancing the cycling efficiency of the coins, although they have independent functions as special machines. This lack of consideration will be supplementarily explained. In a banking system, for example, in case where money is paid and received across the counter between the clerk and the customer while coins being included in the dealings, the coins are repeatedly used either as changes or for adjustment of fractions so that their cycling efficiency is enhanced to a remarkably high level.

In case where the dealings are conducted with such a high coin cycling efficiency, even if the aforementioned coin counting and paying machines are independently arranged, there arise defects that it becomes frequently necessary to manually transfer the coins between those two machines, that the coins are required by such a surplus that the coins are respectively stored in the two machines, and that the spaces for mounting the two machines are enlarged.

SUMMARY OF THE INVENTION

The present invention has been conceived in view of the background thus far described and has an object to provide an automatic coin depositing and paying machine which is enabled to automatically conduct a series of operations to select coins received thereby to return improper ones, to temporarily store the improper coins in coin storing tubes in accordance with the kinds thereof, and to pay off and out the stored coins one by one in response to the necessity, whereby it can enhance the cycling efficiency of the coins so that it is suitable as the window machine of a banking system or the like.

According to a feature of the present invention, there is provided an automatic coin depositing and paying machine comprising: a received coin transfer passage for receiving inserted coins one by one; a first discriminator for discriminating the kinds and so on of the coins being transferred on said received coin transfer passage; first and second shutters for temporarily storing the coins which have been discriminated by the first-named discriminator; a lift belt for returning the received coins to the exit of said machine; a horizontal transfer passage for receiving the coins from the second-named shutter and sending out the same one by one in a horizontal direction; a second discriminator for discriminating the kinds of the coins on said horizontal transfer passages; a plurality of coin storing tubes for respectively receiving coins, which have their kinds discriminated by the second-named discriminator, in accordance with the discriminated kinds from said horizontal transfer passage; and a pay-off mechanism for paying off the coins one by one from the lower portions of said coin storing tubes onto said lift belt to pay out the same to said exit.

BRIEF DESCRIPTION OF THE DRAWINGS

Other objects, features and advantages of the present invention will become apparent from the following description taken with reference to the accompanying drawings, in which.

DESCRIPTION OF THE PREFERRED EMBODIMENTS

The present invention will be described in the following in connection with the embodiments thereof with reference to the accompanying drawings.

Figure 1:
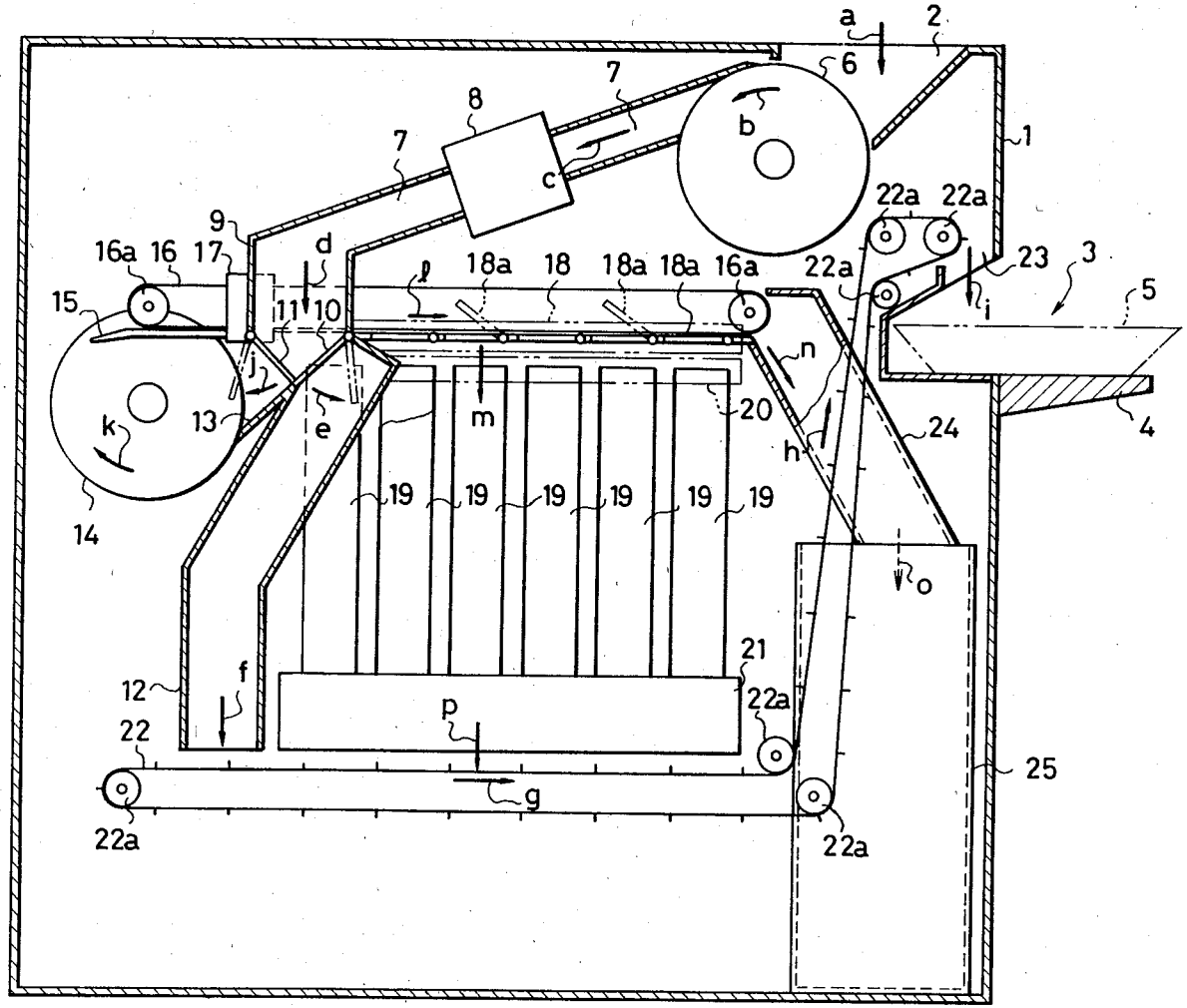
FIG. 1 is a side elevation showing an automatic coin depositing and paying machine embodying the present invention.

FIG. 1 shows one embodiment of the present invention, in which reference numeral 1 indicates a machine body. This machine body 1 is formed at its upper portion with an opening 2 for receiving coins therethrough and at its front side with an exit 3 for paying and returning coins therethrough. The machine body 1 is equipped below that exit 3 with a shelf 4 on which there is placed a carton 5 for receiving the coins to be paid.

In the machine body 1 thus constructed, moreover, there is disposed a rotary disc 6 which is made operative partly to receive the coins inserted into the aforementioned opening 2 and partly to scoop up the coins by means of its pockets or pins thereby to separately let off the scooped coins one by one. A received coin transfer passage 7 is disposed to run below that rotary disc 6 such that it is opened toward the coin exit of the rotary disc 6. Midway of that coin passage 7, there is arranged a first discriminator 8 for discriminating the kinds of the coins. This first discriminator 8 has functions to discriminate the kinds of the coins by detecting the external diameters and materials of the coins so that the kinds and genuinenesses of the coins are determined in dependence upon whether or not the discriminated results of the two functions are coincident.

Into the leading end of the received coin transfer passage 7, moreover, there merges a vertical cylinder 9 for guiding the discriminated coins downward. This vertical cylinder 9 is equipped with first and second shutters 10 and 11 which are hinged thereto in an abutting state for switching the dropping directions of the coins. Below the first shutter 10, there is disposed a first chute 12 for allowing the coins, which have been judged as improper ones by the first discriminator 8, to drop down. Below the second shutter 11, there is disposed a slip slope 13 for guiding the coins which have been judged as proper ones by the first discriminator 8.

In front of the aforementioned slip slope 13, there is disposed another rotary disc 14 for scooping up the coins one by one to separately let off the same. From the coin exit of the rotary disc 14, there extends a horizontal transfer passage, which is constructed of a guide 15 and a horizontal conveyor belt 16 trained on respective rollers **16*a*, 16*a* and so on, so that the coins are conveyed in a horizontal direction, while being clamped separately one by one by pins anchored to the horizontal conveyor belt 16. Midway (e.g., in the vicinity of the inlet) of the transfer passage constructed of those guide and horizontal conveyor belt 15 ang 16, there is disposed a second discriminator 17 for discriminating the kinds of coins in terms of the external diameters of the coins. On the aforementioned transfer passage downstream of that second discriminator 17, there is disposed a gate mechanism 18 which switches its gates 18***a* for the respective coin kinds by the action of solenoids in synchronism with the horizontal conveyor belt 16 in accordance with the discriminated results of the second discriminator 17 thereby to allow the coins to drop through the holes or the like formed in the aforementioned guide 15.

Below the gate mechanism 18, moreover, there are disposed respective coin storing tubes 19 for receiving and piling the coins which have been guided for their respective kinds by the gates 18*a*. To the upper portions of those coins storing tubes 19, there is attached an overflow detector 20 which makes use of a photo-sensor or the like for detecting that the coin storing tubes 19 are filled up with the coins. To the low portions of the coin storing tubes 19, on the other hand, there is attached a pay-off mechanism 21 for paying off and allowing the lowermost coins to drop down one by one out of the tubes 19.

Below the aforementioned first chute 12 and the pay-off mechanism 21, furthermore, there extends a lift belt 22 which is trained on respective rollers 22*a*, 22*a* and so on thereby to convey the coins having dropped to the vicinity of the front exit 3 of the machine body 1. In the vicinity of a position in which the upper portions of the belt is turned down, there is formed a drop hole 23 which leads to the aforementioned exit 3.

At the front end portions (which are located to protrude from the gate mechanism 18 in the transfer direction) of the aforementioned guide and horizontal conveyor belt 15 and 16, there is disposed a second chute 24 for collecting the coins which are not stored in the respective coin storing tubes 19. A safe 25 for storing coins is so fitted in the machine body 1 below the second chute 24 that it can be drawn out of the machine body 1.

In the automatic coin depositing and paying machine having construction thus far described, when coins are so inserted into the opening 2 as are indicated by an arrow (a) appearing in FIG. 1, the rotary disc 6 turns in the direction of arrow (b) so that it feeds the received coin transfer passage 7 with the coins one by one. The coins on the transfer passage 7 are transferred, as indicated by an arrow (c), so that they are inspected as to their diameters and materials by the first discriminator 8, until they are temporarily stored in the vertical cylinder 9, as indicated by an arrow (d).

In case where at least one improper coin is mixed in the coins inserted, the first shutter 10 is opened to the position of a double-dotted line, as indicated by an arrow (e), to allow all the coins to drop through the first chute 12 onto the lift belt 22, as indicated by an arrow (f), so that they are conveyed, as indicated by arrows (g), (h) and (i), by the lift belt until they are returned through the drop hole 23 to the exit 3. Thus, in case where the coins are returned, their abnormal one of ones are checked for subsequent re-depositing treatment.

In case where all the coins inserted are proper, on the other hand, the second shutter 11 is opened to the position of a double-dotted line, as indicated by an arrow (j), to allow the coins to drop through the slip slope 13 onto the rotary disc 14 so that the coins are introduced one by one into the gap between the guide 15 and the horizontal conveyor belt 16 by the rotations of the rotary disc 14 in the direction of arrow (k). Next, at the initial stage of the horizontal conveyance in the direction of arrow (l), the coins have their kinds discriminated by the second discriminator 17, and the gate 18*a* corresponding to the kind discriminated is switched, as indicated by a double-dotted line so that the coins are allowed to drop into and piled in the corresponding coin storing tube 19, as indicated by an arrow (m).

If, at this instant, it is detected by the overflow detector 20 that the coin storing tube 19 corresponding to the kind discriminated is fully occupied, the gate 18*a* corresponding to the kind of the fully occupying coins is left inoperative so that the coins of that particular kind are conveyed out to the second chute 24, as indicated by an arrow (n), and allowed to drop into the safe 25, as indicated by an arrow (o), in which they are stored as genuine or proper ones.

Next, the following description is directed to the case in which the coins are to be paid. When the kind and number of the coins to be paid are designated, the pay-off mechanism 21 pays off the designated number of coins one by one from the coin storing tube 19 of the corresponding kind and allows the same onto the lift belt 22, as indicated by an arrow (p). The coins thus paid off are conveyed, as has been described hereinbefore, by the lift belt 22 in the directions of the arrows (g), (h) and (i) until they are paid out onto the carton 5 lying on the shelf 4.

Figure 2:
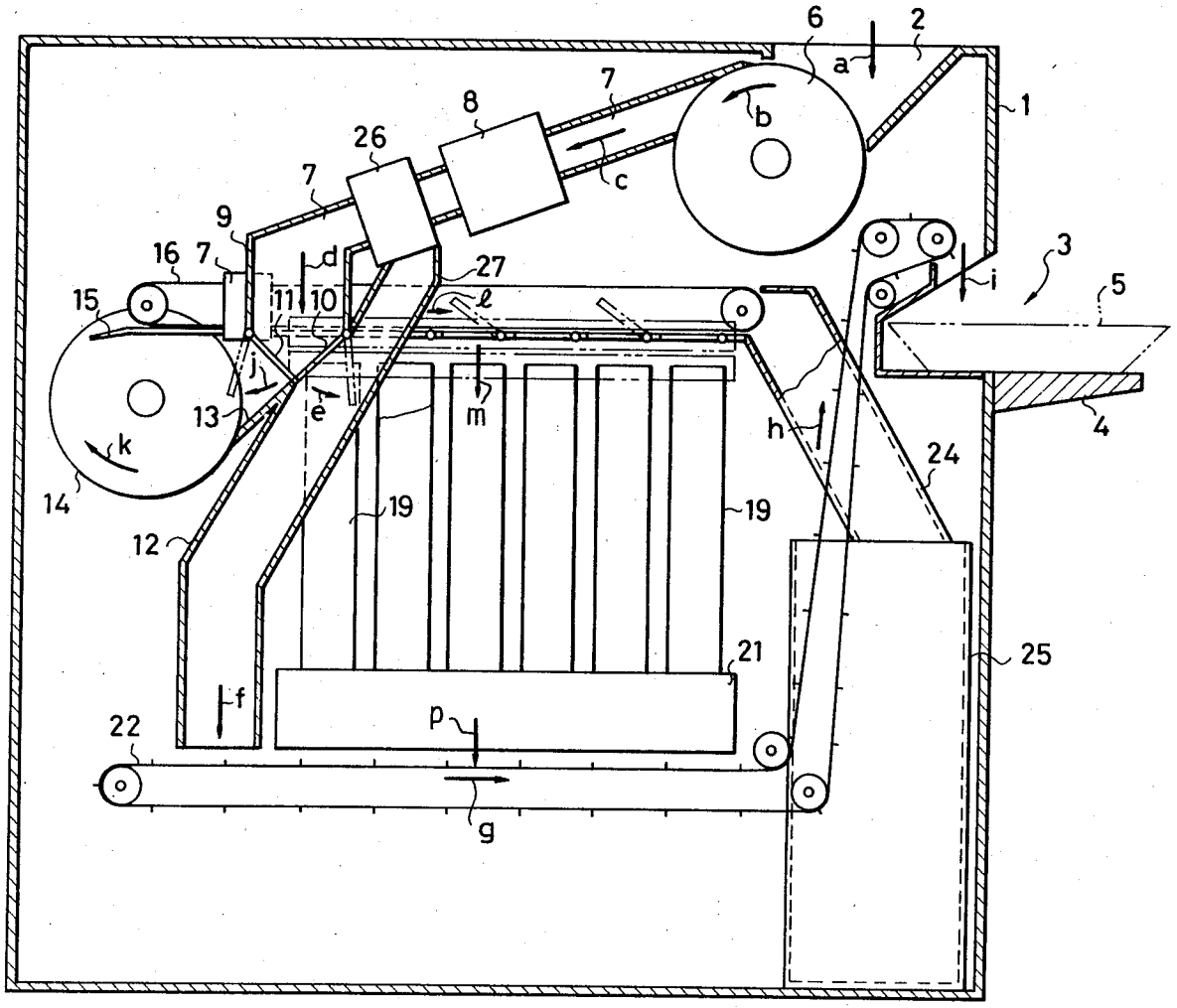
FIG. 2 is similar to FIG. 1 but shows another embodiment of the present invention.

On the other hand, FIG. 2 shows another embodiment of the present invention. In this embodiment, in the received coin transfer passage 7 between the first discriminator 8 and the vertical cylinder 9, there is disposed an undiscriminatable coin exclusing mechanism 26 which is constructed to have its solenoid driven in synchronism with the improper coin signal of the first discriminator 8 to temporarily bring the received coin transfer passage 7 into a closed state thereby to exclude the improper coin, upon each time of discrimination, into the first chute 12 by way of a third chute 27. In case where improper ones are mixed in the inserted coins, they are instantly returned one by one to the exit 3 by way of the first chute 12 and the lift belt 22. On the other hand, let the other case be considered in which only the proper coins are temporarily stored in the vertical cylinder 9. In case where the customer instructs deposit of the coins, all the coins in the vertical cylinder 9 are introduced into the rotary disc 14 so that they may be stored in the respective coin storing tubes 19. In case where the customer instructs return of the coins, on the other hand, the coins are made to drop into the first chute 12 so that they may be returned into the exit 3. The remaining portions are similar to those of the first embodiment so that their repeated explanations are omitted here.

As is now apparent from the description thus far made, the present invention can enjoy following excellent effects.

(1) Those of the coins deposited, which are judged to be proper, are reused so that most of the coins in circulation can be repeatedly used as payable ones. As a result, the amount of coins required for dealings can be reduced to enhance their circulating effect.

(2) The coins inserted are automatically stored as payable ones in the coin storing tubes so that their handling can be simplified without resorting to any aid of clerks.

(3) Since the coin storing tubes have functions to store both the deposited coins and the payable coins, the space for storing the coins can be reduced.

(4) In case where improper coins are mixed in the received ones, they are exclusively returned, and whether or not the remaining proper coins are received can be selected to enhance the reliability for the customers.

What is claimed is:

1. An automatic coin depositing and paying machine comprising:

a body, an opening located at the upper portion of the body for receiving coins therethrough, first coin transfer means communicating at one end with said opening for inclinedly and downwardly transferring coins from said opening one by one, first discriminator means located within said first coin transfer means for discriminating acceptable and unacceptable coins and for generating a first signal representative of one of acceptable and unacceptable coins, temporary storage means located at the other end of said first coin transfer means for temporarily storing coins having passed through said first coin transfer means, conveying means communicating with said temporary storage means for selectively receiving coins from said temporary storage means in response to said first signal, horizontal transfer means having one end located adjacent said conveying means for receiving coins from said conveying means and for conveying the coins horizontally, second discriminator means located within said horizontal transfer means for discriminating the denomination of coins and for generating a second signal representative of the denomination of a coin, a plurality of coin storing means located downstream of and below said horizontal transfer means for receiving coins therein in accordance with the denomination of each coin in response to said second signal, pay-off means located at the bottom of each said plurality of coin storing means for paying out coins one by one from the bottom of each of said plurality of coin storing means, second coin transfer means communicating with said temporary storage means for selectively receiving coins in response to said first signal and guiding coins downwardly, an exit defined by the body and located adjacent said opening for discharging coins therethrough, and lift means having a first portion located below said plurality of coin storing means and said second transfer means for receiving coins therefrom and a second portion for conveying received coins to said exit.

2. A machine according to claim 1, wherein said temporary storage means comprises a first shutter for selectively allowing coins to be introduced into said second coin transfer means and a second shutter for selectively allowing coins to be introduced into said conveying means.

3. A machine according to claim 2, wherein said first shutter is opened to allow coins to be introduced into said second coin transfer means when an unacceptable coin is detected, and said second shutter is opened to allow coins to be introduced into said conveying means when an acceptable coin is detected.

4. A machine according to claim 1, further comprising an unacceptable coin excluding means interposed between said first discriminator means and said temporary storage means for receiving coins when an unacceptable coin is detected by said first discriminator means.

5. A machine according to claim 4, wherein said unacceptable coin excluding means is in communication with said second coin transfer means for conveying unacceptable coins to the second coin transfer means.

6. A machine according to claim 1, further comprising an overflow detector means located in the upper portion of each of said plurality of coin storing means for detecting when each of said plurality of coin storing means if filled with coins.

* * * * *